US006484682B2

(12) United States Patent
Danesh et al.

(10) Patent No.: US 6,484,682 B2
(45) Date of Patent: Nov. 26, 2002

(54) ROCKER ARM ASSEMBLY

(75) Inventors: Paymon Danesh, Chicago; Martin R. Zielke, Lockport, both of IL (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 29 days.

(21) Appl. No.: 09/769,610

(22) Filed: Jan. 25, 2001

(65) Prior Publication Data

US 2002/0017253 A1 Feb. 14, 2002

Related U.S. Application Data

(60) Provisional application No. 60/178,164, filed on Jan. 26, 2000.

(51) Int. Cl.[7] ..... F01L 1/18

(52) U.S. Cl. ..... 123/90.39; 123/90.41; 123/90.42

(58) Field of Search ..... 123/90.39, 90.4, 123/90.41, 90.42

(56) References Cited

U.S. PATENT DOCUMENTS

| | | | | | |
|---|---|---|---|---|---|
| 4,655,177 | A | | 4/1987 | Wells et al. | |
| 4,718,379 | A | | 1/1988 | Clark | |
| 4,934,323 | A | * | 6/1990 | Grinsteiner | 123/90.42 |
| 5,074,261 | A | | 12/1991 | Hamburg et al. | |
| 5,123,384 | A | | 6/1992 | Abbas | |
| 5,329,891 | A | | 7/1994 | Murphy et al. | |
| 5,437,209 | A | | 8/1995 | Santoro | |
| 5,657,726 | A | | 8/1997 | Diggs | |
| 5,709,181 | A | | 1/1998 | Williams | |
| 5,775,280 | A | * | 7/1998 | Schmidt et al. | 123/90.41 |
| 5,806,475 | A | | 9/1998 | Hausknecht | |
| 5,970,932 | A | | 10/1999 | Richardson et al. | |
| 5,979,383 | A | | 11/1999 | Faville et al. | |
| 6,047,675 | A | * | 4/2000 | Kunz | 123/90.41 |
| 6,138,626 | A | * | 10/2000 | Speil | 123/90.39 |

* cited by examiner

*Primary Examiner*—Weilun Lo
(74) *Attorney, Agent, or Firm*—Dennis Kelly Sullivan; Jeffrey P. Calfa; Neil T. Powell

(57) ABSTRACT

There is provided a rocker arm assembly for mounting on a carrier in an internal combustion engine that can be pre-assembled and installed on the rocker carrier decreasing manufacturing time and cost. The rocker arm assembly comprises a rocker arm, a fulcrum plate, a retaining clip, and a pivot ball that in cooperation with the retaining clip cooperatively connects the fulcrum plate and the rocker arm such that the pivot ball provides a pivot point for the rocker arm to pivot and thereby actuate at least one valve or valve bridge. The rocker arm further comprises a push rod cup, an aperture, pivot ball cup, and a pivot foot. The fulcrum plate can be a dual fulcrum plate, which holds two rocker arms, or an end fulcrum plate, which holds one rocker arm. The rocker arms can be either intake or exhaust rocker arms.

25 Claims, 16 Drawing Sheets

ROCKER ARM, PIVOT FOOT AND PIVOT FOOT CLIP

VIEW E
TYPICAL ASSEMBLY
DUAL FULCRUM
DUAL ROCKER ARMS

SECTION H-H

VIEW D
TYPICAL ASSEMBLY
FIRST END FULCRUM
INTAKE ROCKER ARM

SECTION G-G

VIEW F
TYPICAL ASSEMBLY
SECOND END FULCRUM
EXHAUST ROCKER ARM

SECTION J-J

SECTION A-A

SECTION C-C
TYP ASSEMBLY FOR
EXHAUST ROCKER ARMS

SECTION B-B
TYP ASSEMBLY FOR
INTAKE ROCKER ARMS

SECTION D-D
TYP ASSEMBLY
RETAINER ROCKER ARMS - INTAKE

SECTION E-E
TYP ASSEMBLY
RETAINER ROCKER ARMS - EXHAUST

DUAL ROCKER FULCRUM PLATE

BOTTOM VIEW

END INTAKE ROCKER FULCRUM PLATE

BOTTOM VIEW

END EXHAUST ROCKER FULCRUM PLATE

ROCKER ARM, PIVOT FOOT AND PIVOT FOOT CLIP

RETAINING CLIP

RETAINING CLIP ORIENTATION
(LONGER SIDE ON TOP)

INTAKE/EXHAUST ROCKERS

INTAKE ROCKER ASSEMBLED TO FULCRUM

ROCKER ASSEMBLIES
INSTALLED ON CARRIER

CYLINDER HEAD BOLTS INSTALLED AND TIGHTENED

ROCKER ARM ASSEMBLY

This patent application claims the benefit of Provisional U.S. Patent application Serial No. 60/178,164 filed on Jan. 26, 2000.

FIELD OF THE INVENTION

This invention relates generally to valve trains in internal combustion engines. More particularly, this invention relates to valve trains using rocker arms to actuate intake and exhaust valves in a diesel engine.

BACKGROUND OF THE INVENTION

Internal combustion engines have rocker arms to actuate intake and exhaust valves, which permit air to enter and exhaust to leave each cylinder. There are separate rocker arms for each valve. Push rods cause the rocker arms to rotate or pivot and thereby actuate the valves. The push rods extend through the engine to connect to a camshaft. As the camshaft rotates, the push rods move the rocker arms to open and close the valves. The camshaft is designed to open and close the valves in conjunction with the cycling of the piston in the cylinder.

Some rocker arm designs are made from castings. To reduce the weight and bulkiness associated with castings, recent rocker arm designs are made of plate material. However, the plate designs require pre-assembly into a rocker arm assembly for ease of installation in the engine. A clip is used to pre-assemble the rocker arm assembly. The clips are difficult to install and often do not keep the rocker arm assembly together before installation. In addition, the contact point between the rocker arm and the valve in these designs does not remain level as the rocker arm rotates which causes wear on the surface of the valve assembly.

Accordingly, there is a need for a rocker arm assembly having pre-assembly capability and reduced wear on the valve assembly during operation.

SUMMARY OF THE INVENTION

The present invention provides a rocker arm assembly for mounting on a carrier in an internal combustion engine which can be pre-assembled and installed on the rocker carrier to thereby decreased engine manufacturing time and cost. The rocker arm assembly comprises a rocker arm, a fulcrum plate, a retaining clip, and a pivot ball that in cooperation with the retaining clip cooperatively connects the fulcrum plate and the rocker arm such that the pivot ball provides a pivot point for the rocker arm to pivot about and actuate at least one valve or valve bridge. The rocker arm further comprises a push rod cup, an aperture, a pivot ball cup, and a pivot foot. The fulcrum plate in the rocker arm assembly can be a dual fulcrum plate, which would hold two rocker arms, or an end fulcrum plate, which would hold a single rocker arm. Further, the rocker arms can be either an intake rocker arm or an exhaust rocker arm.

The following drawings and description set forth additional advantages and benefits of the invention. More advantages and benefits are obvious from the description and may be learned by practice of the invention.

BRIEF DESCRIPTION OF THE DRAWINGS

The present invention may be better understood when read in connection with the accompanying drawings, of which.

DESCRIPTION OF THE INVENTION

Figure 1:
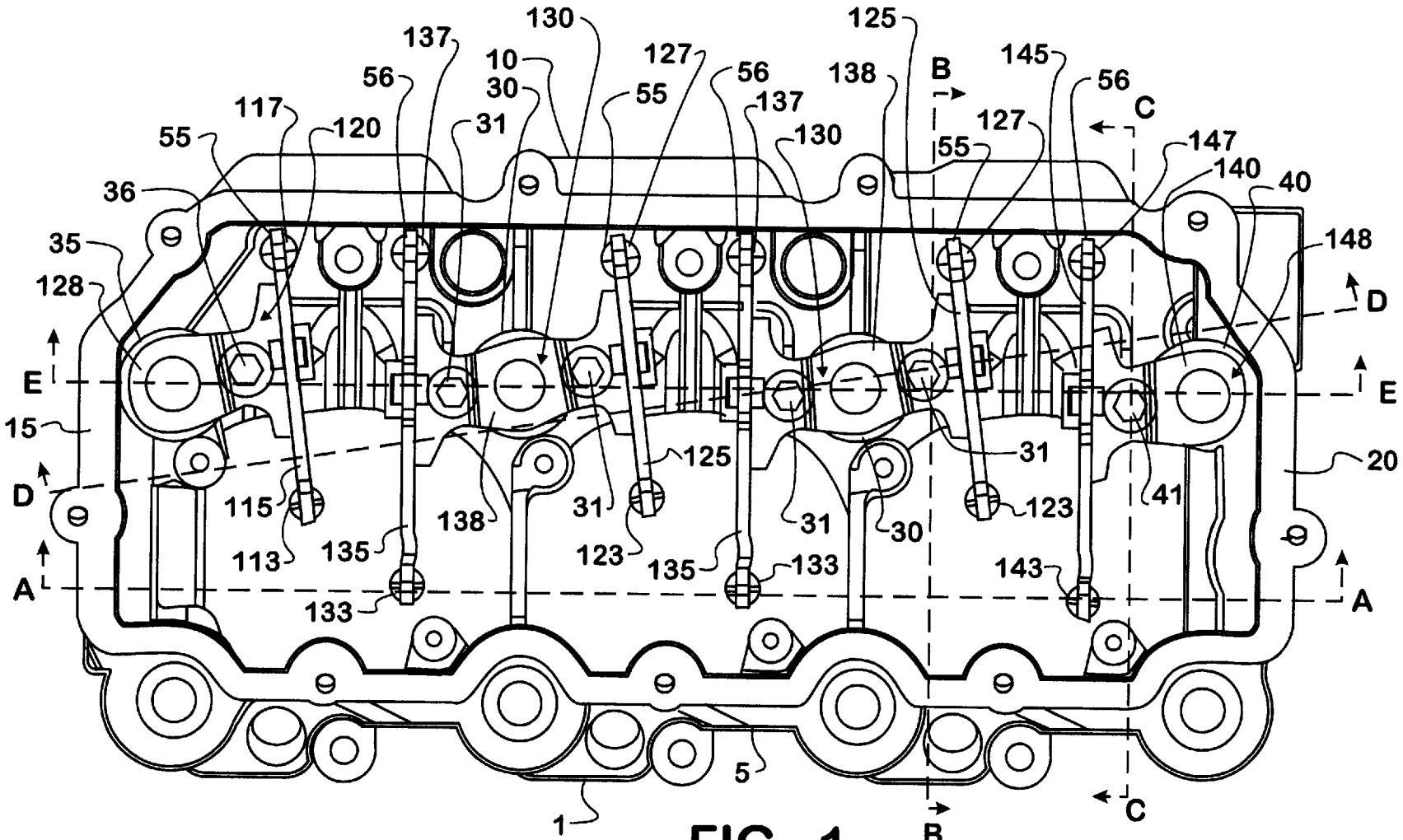
FIG. 1 shows a top view of a rocker arm assembly on a rocker carrier according to the present invention.
Figure 15:
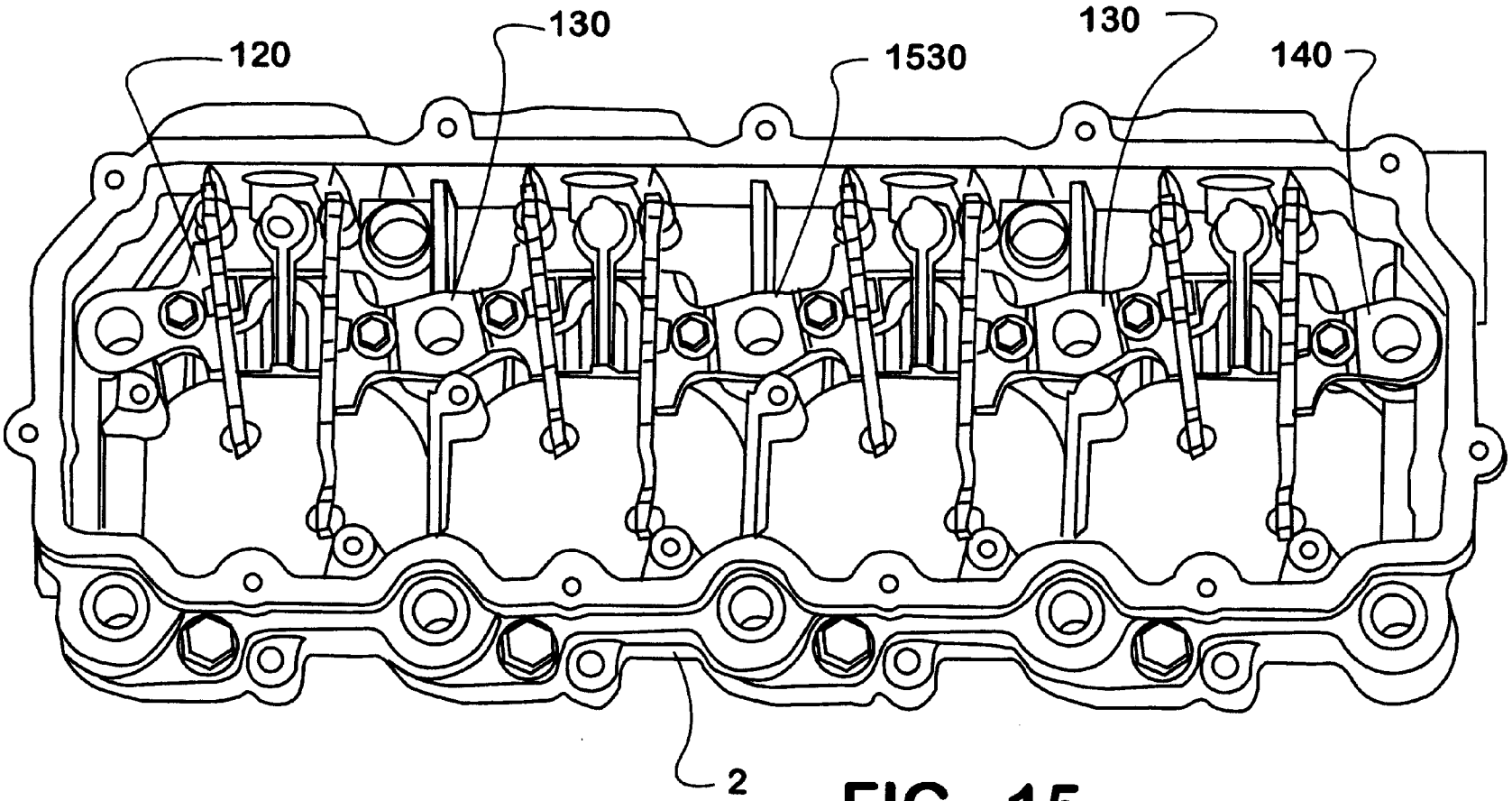
FIG. 15 shows a top perspective view of the rocker arm assembly on a second embodiment of the rocker carrier according to the present invention.

FIG. 1 shows a top view of a rocker arm assembly 120, 130 and 140 on a rocker carrier 1 according to the present invention. The rocker arm assembly 120, 130 and 140 is preferably mounted on a rocker carrier 1 that is adapted for mounting on top of a cylinder head (shown in FIG. 20) in an internal combustion engine, e.g., a gasoline or diesel engine. The rocker arm assembly 120, 130 and 140 depicted in FIG. 1 is mounted on the cylinder head of a six-cylinder engine with V-type configuration. Those of skill in the art will readily recognize that the rocker arm assembly 120, 130 and 140 and corresponding rocker carrier 1 can be easily modified to cooperatively mount on an eight cylinder V-type engine (as shown in FIG. 15). The rocker arm assembly 120, 130 and 140 and carrier 1 could also be adapted for use in in-line cylinder engines or other engine types. Moreover, the rocker arm assembly 120, 130 and 140 can be interchangeably mounted on a rocker carrier 1 that is mountable on either cylinder head bank or side of an engine.

FIG. 1 shows the rocker arm assembly or assemblies 120, 130 and 140 cooperatively mounted on the rocker carrier 1 on corresponding rocker arm pedestals 35, 30 and 40. The rocker arm assemblies 120, 130 and 140 are cooperatively attached to the rocker carrier rocker arm pedestals 35, 30 and 40 by hold down bolts 36, 31 and 41. Additionally, the hold down bolts 36, 31 and 41 shown in FIG. 1 also improve the stiffness of the fulcrum plates 128, 138 and 148 by tying the plates to the rocker carrier 1. The hold down bolts 36, 31 and 41 allow the rocker arm assemblies 120, 130 and 140 to be pre-installed on the rocker carrier 1 before the head bolts 2036, 2031 and 2041 (shown in FIG. 20) are installed. As a result, the rocker arm assemblies 120,130 and 140 can be pre-assembled and installed on the rocker carrier 1 thereby decreasing engine manufacturing time and costs.

The rocker arm assemblies 120, 130 and 140 comprise rocker arms 115, 125, 135 and 145 which are used to actuate corresponding valve bridges (not shown) when actuated by push rods (not shown) at appropriate times. The location of the rocker arm pedestals 35, 30 and 40 is important because the rocker arm pedestals 35, 30 and 40 locate and position the rocker arm assemblies 120, 130 and 140. Correct location of the rocker arm pedestals 30, 35 and 40 will lead to equally distributed loads on the valve bridges (not shown) which actuate the valves. Uneven loading of the valve bridges can result in uneven loading of the valves and edge loading of the stems which leads to premature wear and reduced life of valve stems. The rocker arm assembly can be any of three preferred types of rocker arm assemblies used with the rocker carrier 1, i.e., a first end rocker arm assembly 120, a dual rocker arm assembly 130, or a second end rocker arm assembly 140. Those of skill in the art will readily recognize that other rocker arm assembly 120,130 and 140 configurations are possible and may be used as well.

FIG. 1 shows two dual rocker arm assemblies 130 mounted on respective rocker carrier dual rocker arm end pedestals 30. The dual rocker arm assemblies 130 are preferably mounted in a central part of the rocker carrier 1 between the first and second rocker carrier end walls 15 and 20. The dual rocker arm assemblies 130 have dual rocker arm fulcrum plates 138 which are cooperatively mounted and attached to the dual rocker arm pedestals 30 via hold down bolts 31, e.g., an M-8 type bolt.

The dual rocker arm assembly 130 preferably comprises a dual rocker arm fulcrum plate 138 and two rocker arms 125 and 135. Further, a pivot foot member 1353, a pivot foot clip or fastener 1363 (shown in FIG. 13), a retaining clip 205 and 210 (shown in FIG. 2*a*) and a gage or pivot ball 215 and 220 (shown in FIG. 2*b*) correspond to each rocker arm 125 and 135. The rocker arms 125 and 135 each further preferably comprise a push rod cup 127 and 137, a gage or pivot ball cup 250 and 255 (shown in FIG. 2*b*), a rocker arm aperture 270 and 275 (shown in FIG. 2*b*), and a front or pivot foot 123 and 133 having a pivot foot cup 213 and 233 (shown FIG. 2*b*). The dual rocker arm fulcrum plate 138 preferably provides cooperative support for and holds two rocker arms 125 and 135. The two rocker arms 125 and 135 are preferably an intake rocker arm 125 and an exhaust rocker arm 135. However, the two rocker arms 125 and 135 could be the same in other engine configurations or applications.

Further, the dual fulcrum plate 138 is preferably configured to have to a pair of hold down bolt passages 225 and 230 (shown in FIG. 2*b*) to accept hold down bolts 31 which will tie the dual fulcrum plate 138 to the dual rocker arm pedestal 30. The dual fulcrum plate 138 also preferably comprises a head bolt passage 235 (shown in FIGS. 2*a* and 2*b*) to accept a long head bolt 2031 (shown in FIG. 20) which will assist in fastening the cylinder head 2005 (shown in FIG. 20) to the crank case. The head bolts 2031, 2036, 2041 and 2050 provide the clamp load on the head gasket between the cylinder head and the crank case (not shown) which will result in a more uniform cylinder head to crank case joint.

During an intake cycle, an intake push rod (not shown) in the intake push rod passage 55 will actuate the intake rocker arm 125 via the push rod cup 127. The intake rocker arm 125 will pivot via the gage or pivot ball 220 which will in turn move or swing the intake rocker arm 125 pivot foot 123 downward. The intake pivot foot 123 will in turn actuate intake valves (not shown) via a corresponding intake valve bridge (not shown). During an exhaust cycle, an exhaust push rod (not shown) in the exhaust push rod passage 56 will actuate the exhaust rocker arm 135 via the push rod cup 137. The exhaust rocker arm 135 will pivot via the gage or pivot ball 215 which will in turn move or swing the exhaust rocker arm 135 pivot foot 133 downward. The exhaust pivot foot 133 will in turn actuate exhaust valves (not shown) via a corresponding exhaust valve bridge (not shown). In the preferred embodiment of FIG. 1, the intake and exhaust rocker arms 125 and 135 mounted on the dual fulcrum plate 138 will each operate a valve bridge or valves on different or adjacent engine cylinders or combustion chambers.

FIG. 1, also shows a first end rocker arm assembly 120 mounted on a respective rocker carrier first rocker arm end pedestal 35. The first end rocker arm assembly 120 is preferably mounted adjacent to the first rocker carrier end wall 15. The first end rocker arm assembly 120 has a first rocker arm end fulcrum plate 128 which is cooperatively mounted and attached to the first rocker arm end pedestal 35 via a hold down bolt 36, e.g., an M-8 type bolt.

The first end rocker arm assembly 120 preferably comprises a first rocker arm end fulcrum plate 128 and a rocker arm 115. Further, a pivot foot member 1353, a pivot foot clip or fastener 1363 (shown in FIG. 13), a retaining clip 305 (shown in FIGS. 3*a* and 3*b*) and a gage or pivot ball 315 (shown in FIG. 3*b*) correspond to the rocker arm 115. The rocker arm 115 further preferably comprises a push rod cup 117, a gage or pivot ball cup 350 (shown in FIG. 3*b*), a rocker arm aperture 370 (shown in FIG. 3*b*), and a front or pivot foot 113 having a pivot foot cup 323 (shown FIG. 3*a*). The first rocker arm end fulcrum plate 128 provides cooperative support for and holds one rocker arm 115 which is preferably an intake rocker arm 115. The rocker arm 115 could be an exhaust rocker arm in other engine configurations or applications.

Further, the first end fulcrum plate 128 is preferably configured to have to a hold down bolt passage 325 (shown in FIG. 3*b*) to accept a hold down bolt 36 which will tie the first end fulcrum plate 128 to the first rocker arm end pedestal 35. The first end fulcrum plate 128 also preferably comprises a head bolt passage 335 (shown in FIGS. 3*a* and 3*b*) to accept a long head bolt 2036 (shown in FIG. 20) which will assist in fastening the cylinder head 2005 (shown in FIG. 20) to the crankcase.

During an intake cycle, an intake push rod (not shown) in the intake push rod passage 55 will actuate the intake rocker arm 115 via the push rod cup 117. The intake rocker arm 115 will pivot via the gage or pivot ball 315 which will in turn move or swing the intake rocker arm 115 pivot foot 113 downward. The intake pivot foot 113 will in turn actuate intake valves (not shown) via a corresponding intake valve bridge (not shown).

FIG. 1 also shows a second end rocker arm assembly 140 mounted on a respective rocker carrier second rocker arm end pedestal 40. The second end rocker arm assembly 140 is preferably mounted adjacent to the second rocker carrier end wall 20. The second end rocker arm assembly 140 has a second rocker arm end fulcrum plate 148 which is cooperatively mounted and attached to the second rocker arm end pedestal 40 via a hold down bolt 41, e.g., an M-8 type bolt.

The second end rocker arm assembly 140 preferably comprises a second rocker arm end fulcrum plate 148 and a rocker arm 145. Further, a pivot foot member 1353, a pivot foot clip or fastener 1363 (shown in FIG. 13), a retaining clip 405 (shown in FIGS. 4*a* and 4*b*) and a gage or pivot ball 415 (shown in FIG. 4*b*) correspond to the rocker arm 145. The rocker arm 145 further preferably comprises a push rod cup 147, a gage or pivot ball cup 455 (shown in FIG. 4*b*), a rocker arm aperture 475 (shown in FIG. 4*b*), and a front or pivot foot 143 having a pivot foot cup 433 (shown FIG. 4*a*). The second rocker arm end fulcrum plate 148 provides cooperative support for and holds one rocker arm 145 which is preferably an exhaust rocker arm 145. The rocker arm 145 could be an intake rocker arm in other engine configurations or applications.

Further, the second end fulcrum plate 148 is preferably configured to have to a hold down bolt passage 425 (shown in FIG. 4*b*) to accept a hold down bolt 41 which will tie the second end fulcrum plate 148 to the second rocker arm end pedestal 40. The second end fulcrum plate 148 also preferably comprises a head bolt passage 435 (shown in FIGS. 4*a* and 4*b*) to accept a long head bolt 2041 (shown in FIG. 20) which will assist in fastening the cylinder head 2005 (shown in FIG. 20) to the crank case.

During an exhaust cycle, an exhaust push rod (not shown) in the exhaust push rod passage 56 will actuate the exhaust rocker arm 145 via the push rod cup 147. The exhaust rocker arm 145 will pivot via the gage or pivot ball 415 which will in turn move or swing the exhaust rocker arm 145 pivot foot 143 downward. The exhaust pivot foot 143 will in turn actuate exhaust valves (not shown) via a corresponding exhaust valve bridge (not shown).

Figure 2A:
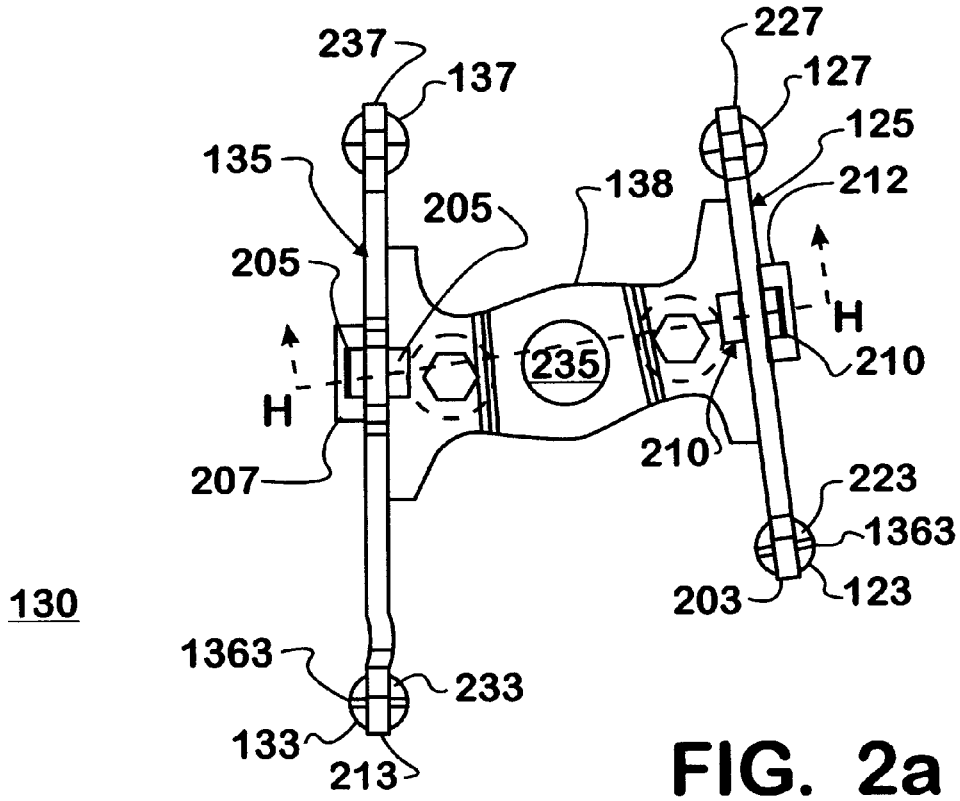
FIG. 2*a* shows a top view of a dual rocker arm assembly shown in FIG. 1 according to the present invention.

FIG. 2*a* shows a top view of a dual rocker arm assembly 130 shown in FIG. 1. FIG. 2*a* shows a dual rocker arm fulcrum plate 138 with an intake 125 and exhaust 135 rocker arm. The intake and exhaust rocker arms 125 and 135 have push rod cups 127 and 137 on one end 227 and 237 and pivot foots 123 and 133 on opposing front end 203 and 213. The rocker arms 125 and 135 are shown cooperatively attached to the dual fulcrum plate 138 by corresponding rocker arm retaining clips 205 and 210.

Also partially shown are pivot foot retaining clips or fasteners 1363 (shown in FIG. 13) secured to the pivot foot cup 223 and 233 on the front end 203 and 213 of the rocker arms 125 and 135. The pivot foot clips 1363 preferably secure a pivot foot member 1353 (shown in FIG. 13) in the pivot foot cups 223 and 233 which correspond to the pivot foot 123 and 133 of the rocker arms 125 and 135. Securing prongs 1365 (shown in FIG. 13) of the pivot foot clip 1363 are preferably wrapped around the outside of the pivot foot cups 223 and 233 to secure the pivot foot member 1353 therein. Those of skill in the art will readily recognize that the pivot foot retaining clip 1363 can be configured differently and secured to the rocker arm differently. For example, the pivot foot clip 1363 could instead wrap the securing prongs 1365 completely around the front end 203 and 213 of the rocker arm 125 and 135, or insert the securing prongs 1365 in the front end 203 and 213, to secure the pivot foot member 1353 therein.

Figure 2B:
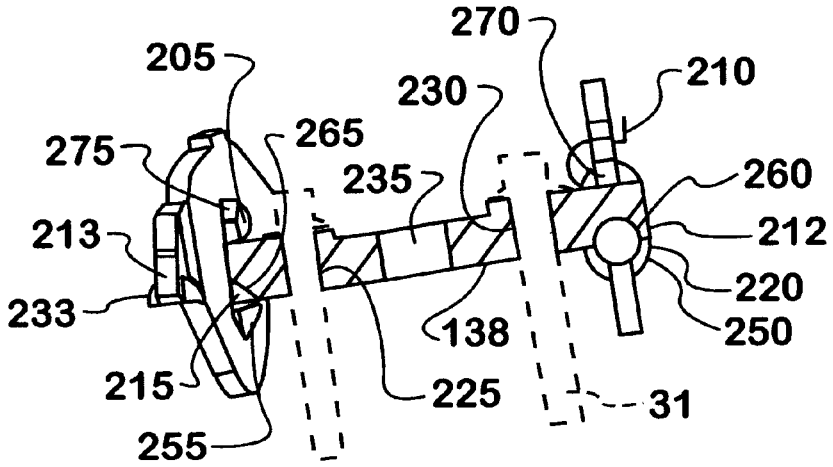
FIG. 2*b* shows a perspective section view along the line H—H of the dual rocker arm assembly shown in FIG. 2*a;*

FIG. 2*b* shows a perspective section view along the line H—H of the dual rocker arm assembly 130 shown in FIG. 2*a*. FIG. 2*b* shows that the dual fulcrum plate 138 preferably comprises a pair of hold down bolt passages 225 and 230 to accept hold down bolts 31 which will tie down the dual fulcrum plate 138 to the dual rocker arm pedestal 30 (shown in FIG. 1). The dual fulcrum plate 138 also preferably comprises a head bolt passage 235 to accept a long head bolt 2031 (shown in FIG. 20) which will assist in fastening the cylinder head 2005 (shown in FIG. 20) to the crank case.

FIG. 2*b* also shows the preferred dual rocker arm assembly 130. In the dual rocker arm assembly 130, the rocker arm retaining clips 205 & 210 (also shown in FIGS. 14*a* and 14*b*) and the gage or pivot ball 215 and 220 have a preferred configuration or preferred positioning such that the rocker arms 125 and 135 can be cooperatively mounted or attached to the dual fulcrum plate 138.

The rocker arm clip 205 and 210 mounts onto the ends 207 and 212 of the dual fulcrum plate, preferably via a compression fit. The rocker arm 125 and 135 is placed on the retainer clip top portion 1405 (shown in FIG. 14*a*) via the rocker arm aperture 270 and 275 (shown in FIG. 13). The rocker arm aperture 270 and 275 preferably has the gage or pivot ball cup 250 and 255 at the bottom 1375 (shown in FIG. 13) of the rocker arm aperture 270 and 275. The rocker arm 125 and 135 could also have another appropriate configuration that will hold the pivot ball 215 and 220. The gage or pivot ball 215 and 220 is placed in the pivot ball cup 250 and 255. The retainer clip top portion 1405 is then compressed, by pushing on the rocker arm 125 and 135 and moving or swinging the rocker arm 125 and 135 towards the dual fulcrum plate 138 until the pivot ball 215 and 220 "snaps" into an indent portion or pivot ball area 260 and 265 in the underside of the dual fulcrum plate 138.

The dual rocker arm assembly 130 is now preferably assembled and operational. The gage or pivot ball 215 and 220 allows the rocker arm 125 and 135 to pivot. The retainer clip 205 arid 210 and the pivot ball 215 and 220 also maintain the rocker arms 125 and 135 cooperatively coupled or attached to the dual fulcrum plate 138. The rocker arms 125 and 135 can be disassembled by again compressing the rocker arm 125 and 135 against the retainer clip top portion 1405 and swinging the rocker arms 125 and 135 out away from the dual fulcrum plate 138.

Figure 3A:
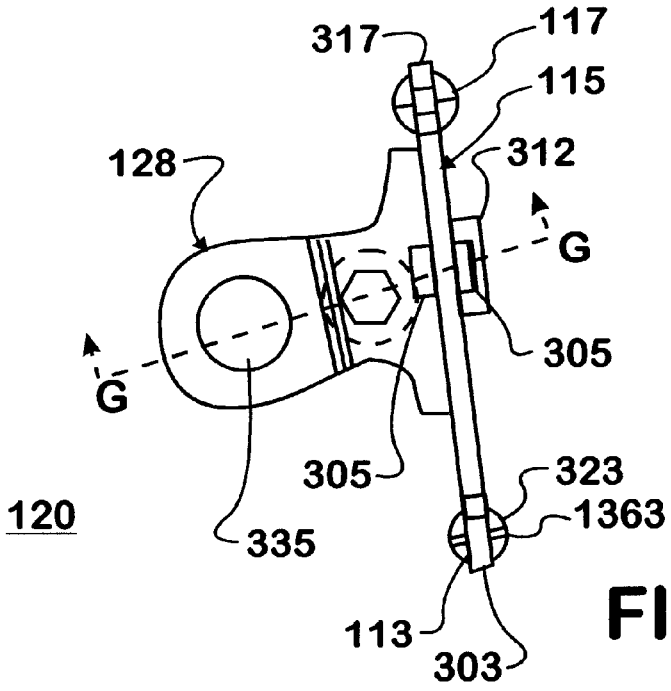
FIG. 3*a* shows a top view of a first end rocker arm assembly shown in FIG. 1 according to the present invention.

FIG. 3*a* shows a top view of a first end rocker arm assembly 120 shown in FIG. 1. FIG. 3*a* shows a first rocker arm end fulcrum plate 128 with an intake rocker arm 115. The intake rocker arm 115 has a push rod cup 117 on a rear end 317 and a pivot foot 113 on an opposing front end 303. The rocker arm 115 is shown cooperatively attached to the first end fulcrum plate 128 by a rocker arm retaining clip 305.

Also partially shown is a pivot foot retaining clip or fastener 1363 (shown in FIG. 13) secured to the pivot foot cup 323 on the front end 303 of the rocker arm 115. The pivot foot clip 1363 is preferably secured to pivot foot member 1353 (shown in FIG. 13) in the pivot foot cup 323 which corresponds to the pivot foot 113 of the rocker arm 115. The pivot foot clip 1363 preferably secures the pivot foot member 1353 (shown in FIG. 13) to the pivot foot cup 323 in the same manner as described for the dual rocker arm fulcrum assembly 130 of FIGS. 2*a* and 2*a*.

Figure 3B:
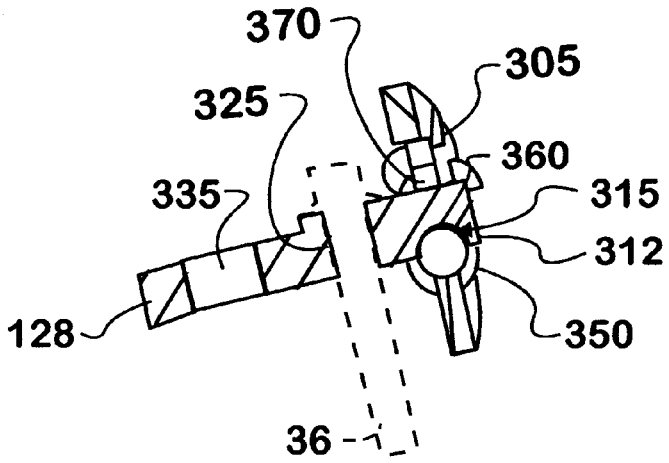
FIG. 3*b* shows a perspective section view along the line G—G of the first end rocker arm assembly shown in FIG. 3*a;*

FIG. 3*b* shows a perspective section view along the line G—G of the first end rocker arm assembly 120 shown in FIG. 3*a*. FIG. 3*b* shows that the first end fulcrum plate 128 preferably comprises a hold down bolt passage 325 to accept a hold down bolt 36 which will tie down the first end fulcrum plate 128 to the first rocker arm end pedestal 35 (shown in FIG. 1). The first end fulcrum plate 128 also preferably comprises a head bolt passage 335 to accept a long head bolt 2036 (shown in FIG. 20) which will assist in fastening the cylinder head 2005 (shown in FIG. 20) to the crank case.

FIG. 3*b* also shows the preferred first end rocker arm assembly 120. In the first end rocker arm assembly 120, the rocker arm retaining clip 305 (also shown in FIGS. 14*a* and 14*b*) and the gage or pivot ball 315 have a preferred configuration or preferred positioning such that the rocker arm 115 can be cooperatively mounted or attached to the first end fulcrum plate 128.

The rocker arm retainer clip 305 mounts onto an end 312 of the first end fulcrum plate 128, preferably via a compression fit. The rocker arm 115 is placed on the retainer clip top portion 1405 (shown in FIG. 14*a*) via the rocker arm aperture 370 (similar to one shown in FIG. 13). The rocker arm aperture 370 preferably has the gage or pivot ball cup 350 at the bottom 1375 (shown in FIG. 13) of the rocker arm aperture 370. The rocker arm 115 could also have another appropriate configuration that will hold the pivot ball 315. The gage or pivot ball 315 is placed in the pivot ball cup 350. The retainer clip top portion 1405 is then compressed, by pushing on the rocker arm 115 and moving or swinging the rocker arm 115 towards the first end fulcrum plate 128 until the pivot ball 315 "snaps" into an indent portion or pivot ball area 360 in the underside of the first end fulcrum plate 138.

The first end rocker arm assembly 120 is now preferably assembled and operational. The gage or pivot ball 315 allows the rocker arm 115 to pivot. The retainer clip 305 and the pivot ball 315 also maintain the rocker arm 115 cooperatively coupled or attached to the first end fulcrum plate 128. The rocker arm 115 can be disassembled by again compressing the rocker arm 115 against the retainer clip top portion 1405 and swinging the rocker arm 115 out away from the first end fulcrum plate 128.

Figure 4A:
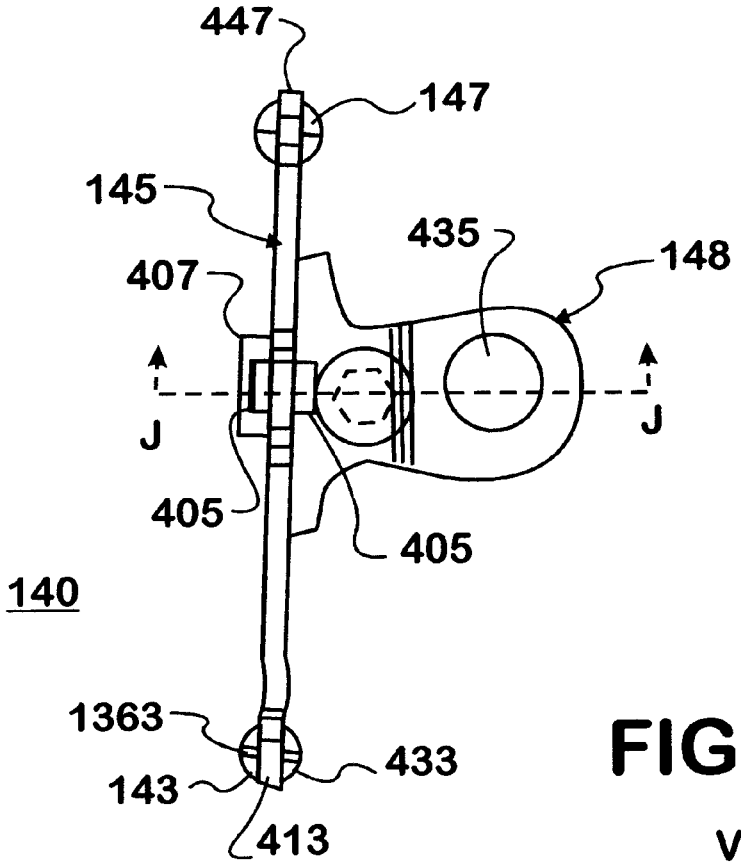
FIG. 4*a* shows a top view of a second end rocker arm assembly shown in FIG. 1 according to the present invention.

FIG. 4*a* shows a top view of a second end rocker arm assembly 140 shown in FIG. 1. FIG. 4*a* shows a second rocker arm end fulcrum plate 148 with an exhaust rocker arm 145. The exhaust rocker arm 145 has a push rod cup 147 on a rear end 447 and a pivot foot 143 on an opposing front end 413. The rocker arm 145 is shown cooperatively attached to the second end fulcrum plate 148 by a rocker arm retaining clip 405.

Also partially shown is a pivot foot retaining clip or fastener 1363 (shown in FIG. 13) secured to the pivot foot cup 433 on the front end 413 of the rocker arm 145. The pivot foot clip 1363 is preferably secured to pivot foot member 1353 (shown in FIG. 13) in the pivot foot cup 433 which corresponds to the pivot foot 143 of the rocker arm 145. The pivot foot clip 1363 preferably secures the pivot foot member 1353 (shown in FIG. 13) to the pivot foot cup 433 in the same manner as described for the dual rocker arm fulcrum assembly 130 of FIGS. 2*a* and 2*a*.

Figure 4B:
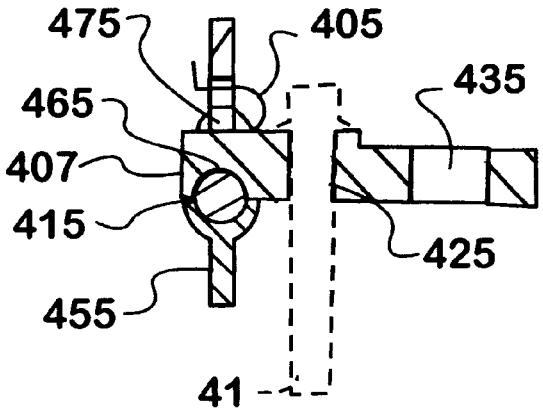
FIG. 4*b* shows a perspective section view along the line J—J of the second end rocker arm assembly shown in FIG. 4*a;*

FIG. 4*b* shows a perspective section view along the line J—J of the second end rocker arm assembly 140 shown in FIG. 4*a*. FIG. 4*b* shows that the second end fulcrum plate 148 preferably comprises a hold down bolt passage 425 to accept a hold down bolt 41 which will tie down the second end fulcrum plate 148 to the second rocker arm end pedestal 40 (shown in FIG. 1). The second end fulcrum plate 148 also preferably comprises a head bolt passage 435 to accept a long head bolt 2041 (shown in FIG. 20) which will assist in fastening the cylinder head 2005 (shown in FIG. 20) to the crank case.

FIG. 4*b* also shows the preferred second end rocker arm assembly 140. In the second end rocker arm assembly 140, the rocker arm retaining clip 405 (also shown in FIGS. 14*a* and 14*b*) and the gage or pivot ball 415 have a preferred configuration or preferred positioning such that the rocker arm 145 can be cooperatively mounted or attached to the second end fulcrum plate 148.

The rocker arm retainer clip 405 mounts onto an end 407 of the second end fulcrum plate 148, preferably via a compression fit. The rocker arm 145 is placed on the retainer clip top portion 1405 (shown in FIG. 14*a*) via the rocker arm aperture 475 (similar to one shown in FIG. 13). The rocker arm aperture 475 preferably has the gage or pivot ball cup 455 at the bottom 1375 (shown in FIG. 13) of the rocker arm aperture 475. The rocker arm 145 could also have another appropriate configuration that will hold the pivot ball 415. The gage or pivot ball 415 is placed in the pivot ball cup 455. The retainer clip top portion 1405 is then compressed, by pushing on the rocker arm 145 and moving or swinging the rocker arm 145 towards the first end fulcrum plate 148 until the pivot ball 415 "snaps" into an indent potion or pivot ball area 465 in the underside of the second end fulcrum plate 148.

The second end rocker arm assembly 140 is now preferably assembled and operational. The gage or pivot ball 415 allows the rocker arm 145 to pivot. The retainer clip 405 and the pivot ball 415 also maintain the rocker arm 145 cooperatively coupled or attached to the second end fulcrum plate 148. The rocker arm 145 can be disassembled by again compressing the rocker arm 145 against the retainer clip top portion 1405 and swinging the rocker arm 145 out away from the second end fulcrum plate 148.

Figure 5:
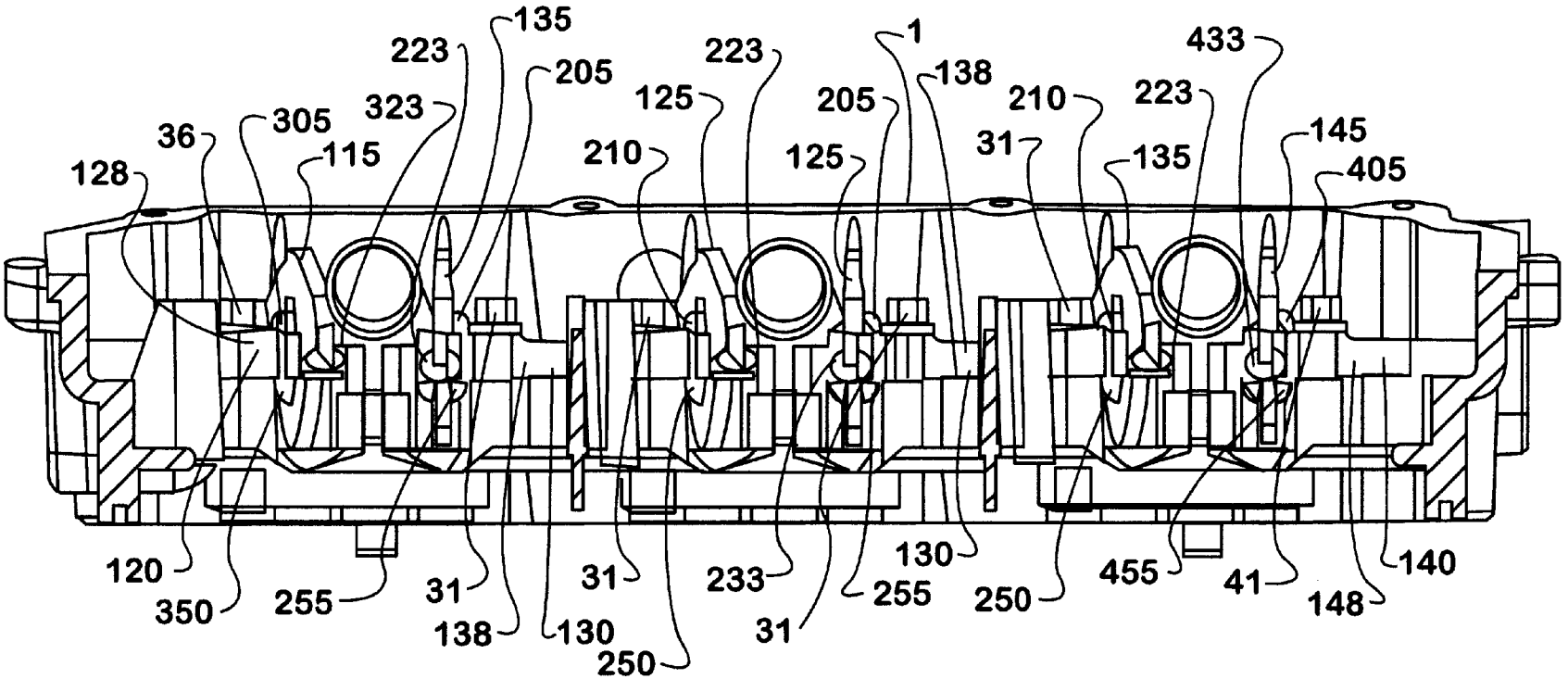
FIG. 5 shows a cross-sectional view along the section line A—A of the rocker arm assembly and rocker carrier shown in FIG. 1.

FIG. 5 shows a cross-sectional view along the section line A—A of the rocker arm assembly 120, 130 and 140 and rocker carrier 1 shown in FIG. 1. FIG. 5 shows the preferred rocker arm assemblies 120, 130 and 140 along with their respective rocker arm 115, 125, 135 and 145 fulcrum plates 128, 138 and 148. The fulcrum plates 128, 138 and 148 are shown attached to the rocker carrier 1 by the appropriate hold down bolts 36, 31 and 41. FIG. 5 also shows a clearer view of the rocker arm retainer clips 205, 210, 305 and 405, the rocker arm pivot foot cups 223, 233, 323 and 433, and the rocker arm pivot ball cups 250, 255, 350 and 455.

Figure 6:
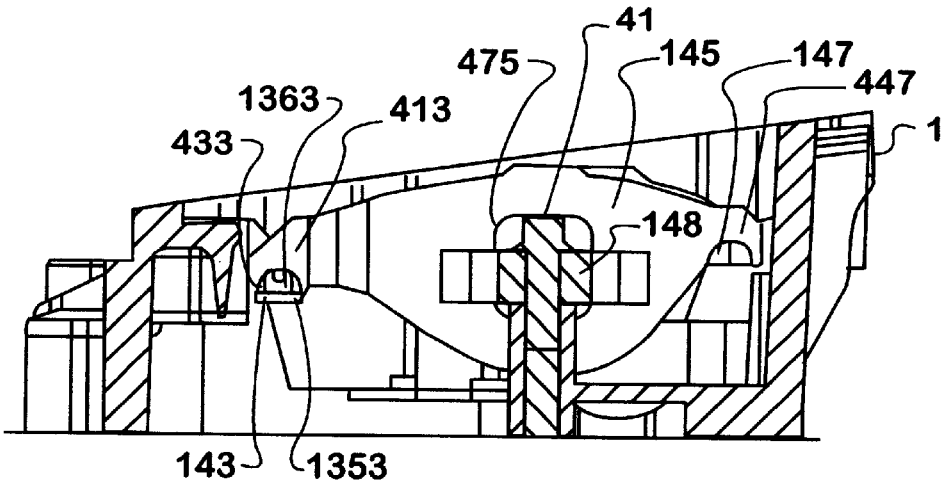
FIG. 6 shows a cross-sectional end view along the section line C—C of an exhaust rocker arm assembly and rocker carrier shown in FIG. 1.

FIG. 6 shows a cross-sectional end view along the section line C—C of the second end rocker arm assembly 140 and rocker carrier 1 shown in FIG. 1. FIG. 6 preferably shows the exhaust rocker arm 145 of the second end rocker arm assembly 140. FIG. 6 shows the rocker arm aperture 475, the push rod cup 147 on the rear end 447 and the pivot foot 143 on an opposing front end 413 of the exhaust rocker arm 145. The rocker arm assembly 140 is shown secured by the second end fulcrum plate 148 to the rocker carrier 1. Also shown is the rocker arm pivot foot 143 which is preferably comprised of pivot foot retaining clip or fastener 1363 securing the pivot foot member 1353 to the pivot foot cup 433 on the front end 413 of the rocker arm 145. The exhaust rocker arm is preferably configured the same for each rocker arm assembly 120, 130 and 140.

Figure 7:
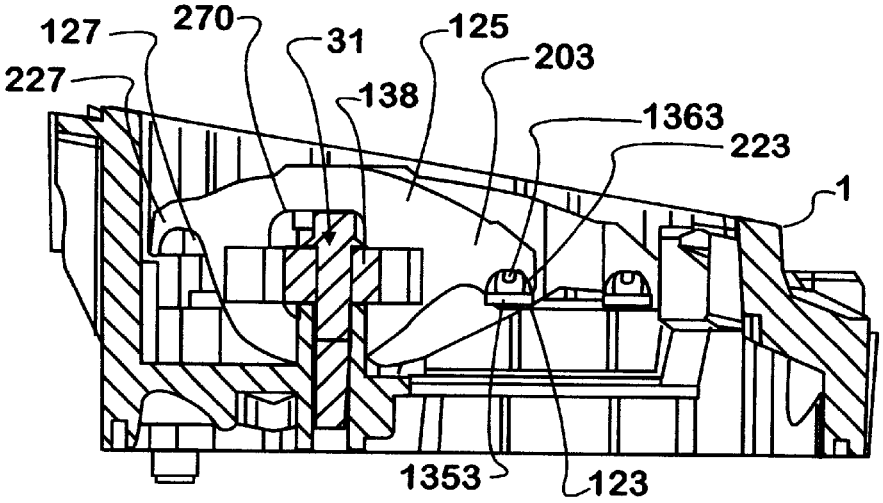
FIG. 7 shows a cross-sectional end view along section B—B of an intake rocker arm assembly and rocker carrier shown in FIG. 1.

FIG. 7 shows a cross-sectional end view along section B—B of the dual rocker arm assembly 130 and rocker carrier 1 shown in FIG. 1. FIG. 7 preferably shows the exhaust intake rocker arm 125 of the dual rocker arm assembly 130. FIG. 7 shows the rocker arm aperture 270, the push rod cup 127 on the rear end 227 and the pivot foot 123 on an opposing front end 203 of the intake rocker arm 125. The rocker arm assembly 130 is shown secured by the dual fulcrum plate 138 to the rocker carrier 1. Also shown is the rocker arm pivot foot 123 which is preferably comprised of pivot foot retaining clip or fastener 1363 securing the pivot foot member 1353 to the pivot foot cup 223 on the front end 203 of the rocker arm 125. The intake rocker arm is preferably configured the same for each rocker arm assembly 120,130 and 140.

Figure 8:
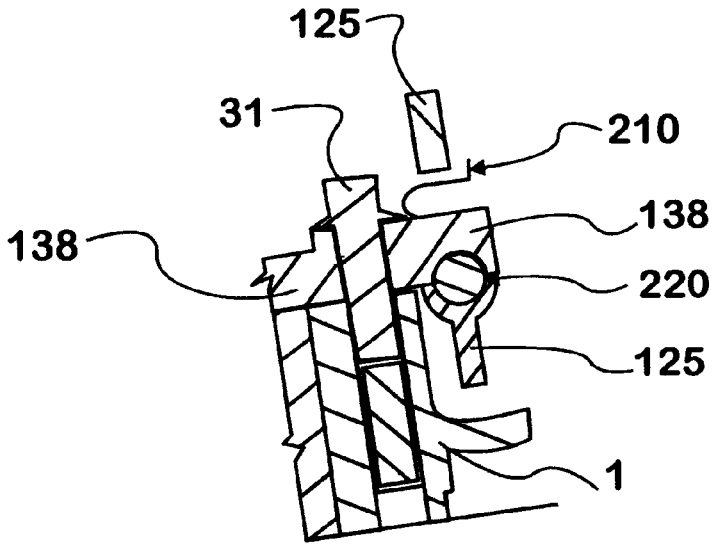
FIG. 8 shows a cross-sectional interior view along the section line D—D of the rocker arm assembly and rocker carrier shown in FIG. 1.

FIG. 8 shows a cross-sectional view along the section line D—D of the rocker arm assembly and rocker carrier shown in FIG. 1. FIG. 8 shows the preferred positioning of the rocker arm retaining clip 210 and the pivot ball 220 relative to the rocker arm 125 and the dual fulcrum plate 138 (also shown and discussed in FIG. 2*b*). FIG. 8 also shows that the dual fulcrum plate 138 is attached to the rocker carrier 1 by a hold down bolt 31. This preferred positioning of the rocker arm retaining clip and the pivot ball is typical for the intake rocker arms 115 and 125 of the first end rocker arm assembly 120 and the dual rocker arm assembly 130.

Figure 9:
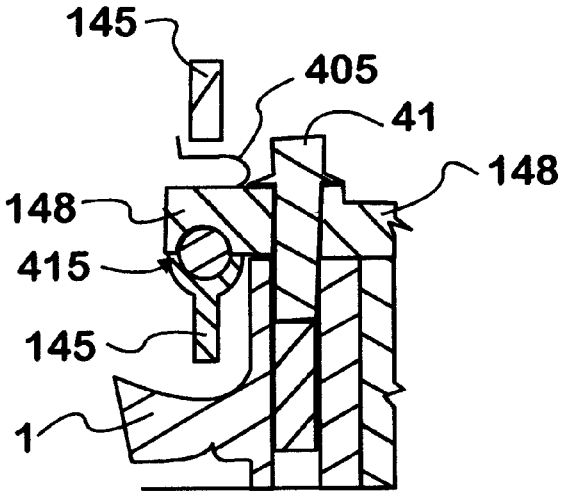
FIG. 9 shows a cross-sectional interior view along the section line E—E of the rocker arm assembly and rocker carrier shown in FIG. 1.

FIG. 9 shows a cross-sectional interior view along the section line E—E of the rocker arm assembly and rocker carrier shown in FIG. 1. FIG. 9 shows the preferred positioning of the rocker arm retaining clip 405 and the pivot ball 415 relative to the rocker arm 145 and the dual fulcrum plate 148 (also shown and discussed in FIG. 4*b*). FIG. 9 also shows that the dual fulcrum plate 148 is attached to the rocker carrier 1 by a hold down bolt 41. This preferred positioning of the rocker arm retaining clip and the pivot ball is typical for the exhaust rocker arms 135 and 145 of the dual rocker arm assembly 130 and the second end rocker arm assembly 140.

Figure 10A:
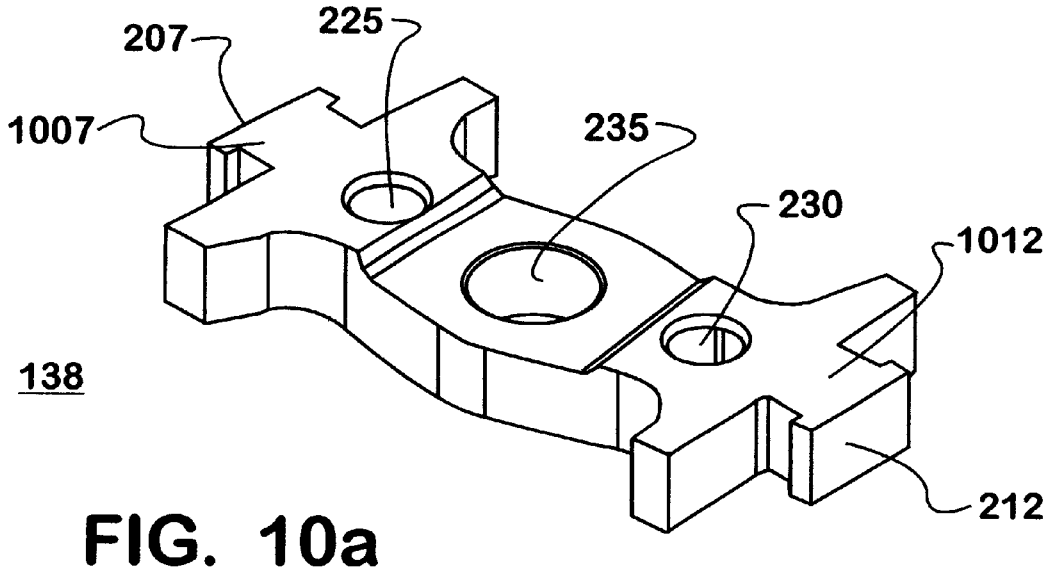
FIGS. 10*a* and 10*b* show a perspective and bottom view of the dual rocker fulcrum plate for the rocker arm assembly shown in FIG. 1.
Figure 10B:
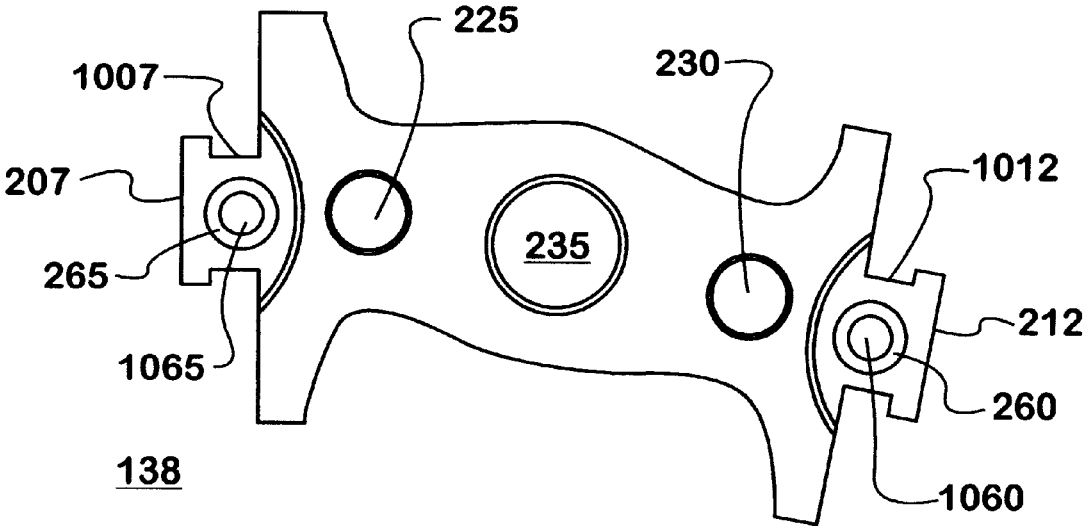

FIGS. 10*a* and 10*b* show a perspective and bottom view of the preferred dual rocker fulcrum plate 138 for the rocker arm assembly 130 shown in FIG. 1. The dual fulcrum plate 138 preferably comprises a pair of hold down bolt passages 225 and 230 which will accept hold down bolts 31 to tie the dual fulcrum plate 138 to the rocker carrier 1. The dual fulcrum plate 138 also comprises a head bolt passage 235 to accept a long head bolt 2031 to assist in fastening the cylinder head 2005 to the crankcase. The dual fulcrum plate 138 can be made of machined out steel, or cast out of steel or powdered metal, e.g., 4140 steel. The dual fulcrum plate has a thickness that is in the range of about 10 mm, and preferably 10 millimeters (mm).

The dual fulcrum plate 138 will preferably accept two rocker arm clips 205 and 210 (shown in FIGS. 2*a* and 2*b*) on two opposing ends 207 and 212. More particularly, the clamp section 1410 (shown in FIGS. 14*a* and 14*b*) of the retaining clips 205 and 210 will be positioned on opposing fulcrum necks 1007 and 1012, preferably via a compression fit. There is also shown the indent portion or pivot ball area 260 and 265 on the underside of the dual fulcrum plate 138 which will accept the pivot ball 215 and 220. The indent portion 260 and 265 is preferably cup shaped to coincide with the pivot ball 215 and 220. However, the indent portion 260 and 265 can have other appropriate configurations that will accept the pivot ball 215 and 220. FIG. 10*b* further shows a divot or dimple 1060 and 1065 in the indent portion 260 and 265 of the dual fulcrum plate 138. The dimples 1060 and 1065 will preferably hold oil for lubrication of parts and will allow for clearance between parts.

Figure 11A:
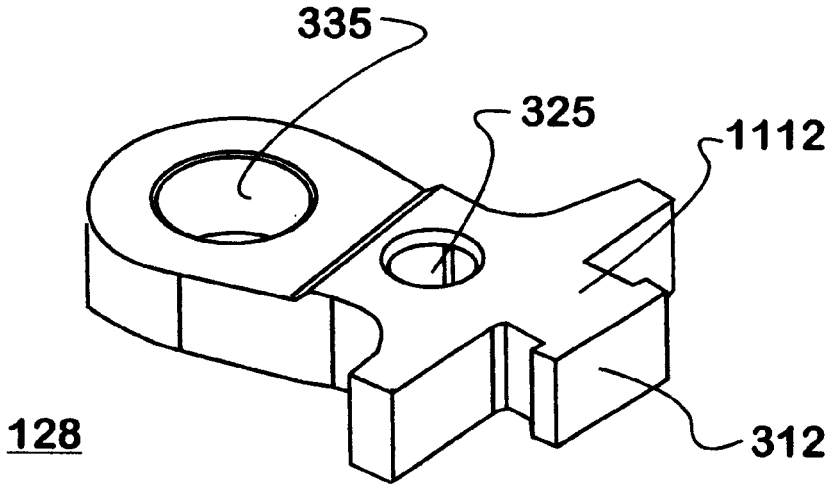
FIGS. 11*a* and 11*b* show a perspective and bottom view of an end intake rocker fulcrum plate of the rocker arm assembly shown in FIG. 1.
Figure 11B:
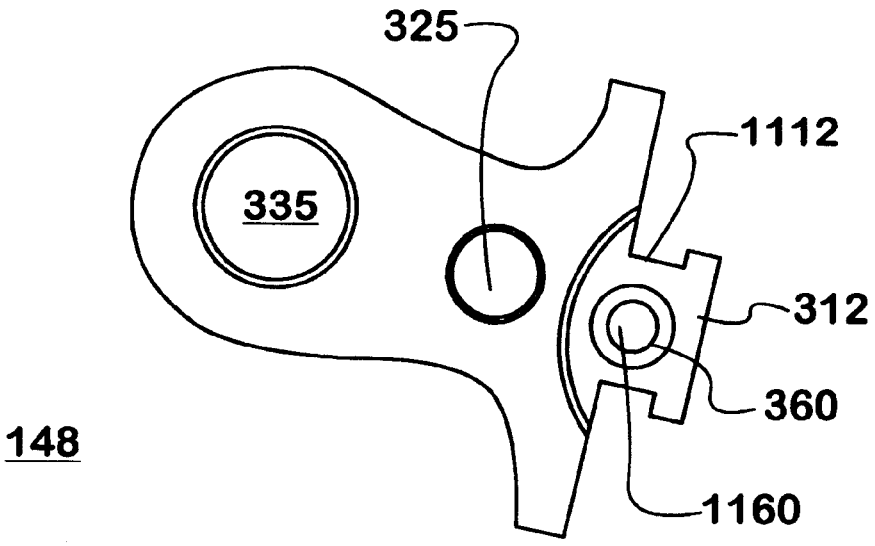

FIGS. 11*a* and 11*b* show a perspective and bottom view of the first end intake rocker fulcrum plate 128 of the rocker arm assembly 120 shown in FIG. 1. The first end fulcrum plate 128 preferably comprises a hold down bolt passage 325 which will accept a hold down bolt 36 to tie the first end fulcrum plate 128 to the rocker carrier 1. The first end fulcrum plate 128 also comprises a head bolt passage 335 to accept a long head bolt 2036 to assist in fastening the cylinder head 2005 to the crank case. The first end fulcrum plate 128 can be made of machined out steel, or cast out of steel or powdered metal, e.g., 4140 steel. The first end fulcrum plate has a thickness that is in the range of about 10 mm, and preferably 10 millimeters (mm). The first end fulcrum plate 128 will preferably accept a rocker arm clip 305 (shown in FIGS. 3*a* and 3*b*) on a plate end 312. More particularly, the clamp section 1410 (shown in FIGS. 14*a* and 14*b*) of the retaining clip 305 will be positioned on a fulcrum neck 1112, preferably via a compression fit. There is also shown the indent portion or pivot ball area 360 on the underside of the first end fulcrum plate 128 which will accept the pivot ball 315. The indent portion 360 is preferably cup shaped to coincide with the pivot ball 315. However, the indent portion 360 can have other appropriate configurations that will accept the pivot ball 315. FIG. 11*b* further shows a divot or dimple 1160 in the indent portion 360 of the first end fulcrum plate 128 and will preferably hold oil for lubrication of parts and will allow for clearance between parts.

Figure 12A:
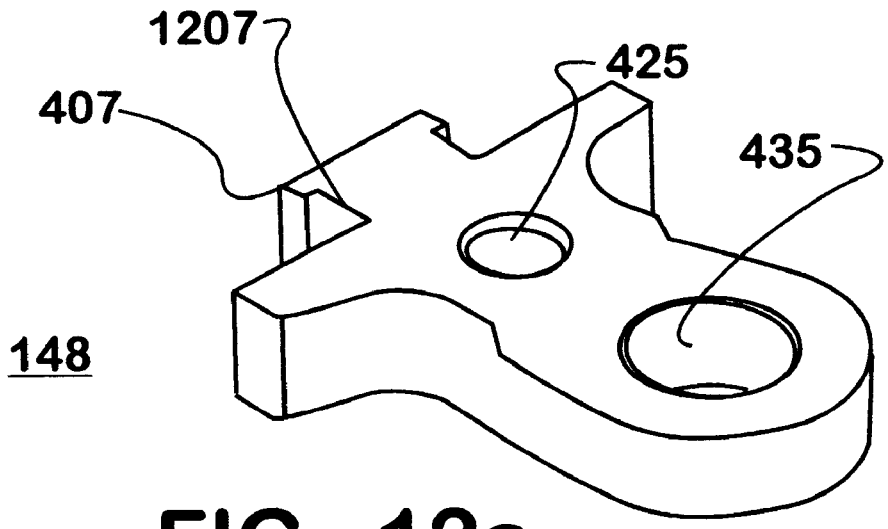
FIGS. 12*a* and 12*b* show a perspective and bottom view of the end exhaust rocker fulcrum plate of the rocker arm assembly shown in FIG. 1.
Figure 12B:
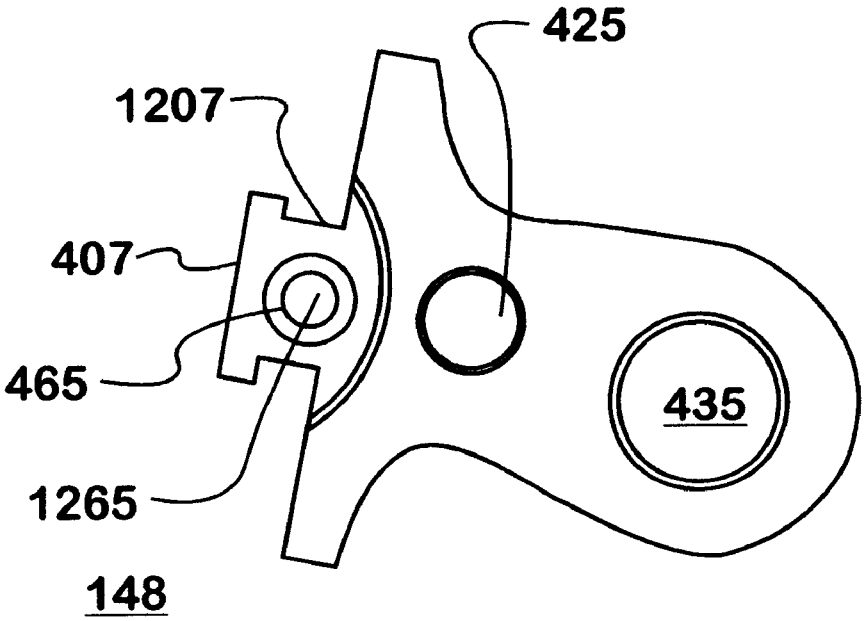

FIGS. 12*a* and 12*b* show a perspective and bottom view of the second end exhaust rocker fulcrum plate 148 of the rocker arm assembly 140 shown in FIG. 1. The second end fulcrum plate 148 preferably comprises a hold down bolt passage 425 which will accept a hold down bolt 41 to tie the second end fulcrum plate 148 to the rocker carrier 1. The second end fulcrum plate 148 also comprises a head bolt passage 435 to accept a long head bolt 2041 to assist in fastening the cylinder head 2005 to the crank case. The second end fulcrum plate 148 can be made of machined out steel, or cast out of steel or powdered metal, e.g., 4140 steel. The second end fulcrum plate has a thickness that is in the range of about 10 mm, and preferably 10 millimeters (mm).

The second end fulcrum plate 148 will preferably accept a rocker arm clip 405 (shown in FIGS. 4*a* and 4*b*) on a plate end 407. More particularly, the clamp section 1410 (shown in FIGS. 14*a* and 14*b*) of the retaining clip 405 will be positioned on a fulcrum neck 1207, preferably via a compression fit. There is also shown the indent portion or pivot ball area 465 on the underside of the first end fulcrum plate 148 which will accept the pivot ball 415. The indent portion 465 is preferably cup shaped to coincide with the pivot ball 415. However, the indent portion 465 can have other appropriate configurations that will accept the pivot ball 415. FIG. 12*b* further shows a divot or dimple 1265 in the indent portion 465 of the second end fulcrum plate 148 and will preferably hold oil for lubrication of parts and will allow for clearance between parts.

Figure 13:
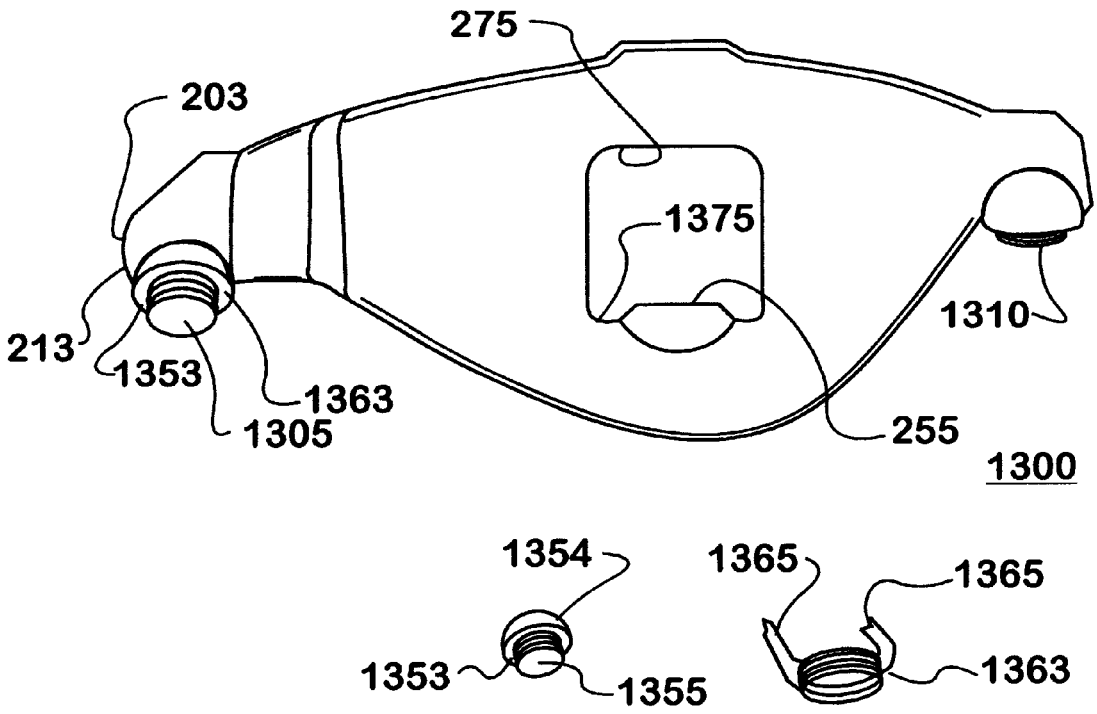
FIG. 13 shows a side view of a rocker arm of the rocker arm assembly shown in FIG. 1.
Figure 17:
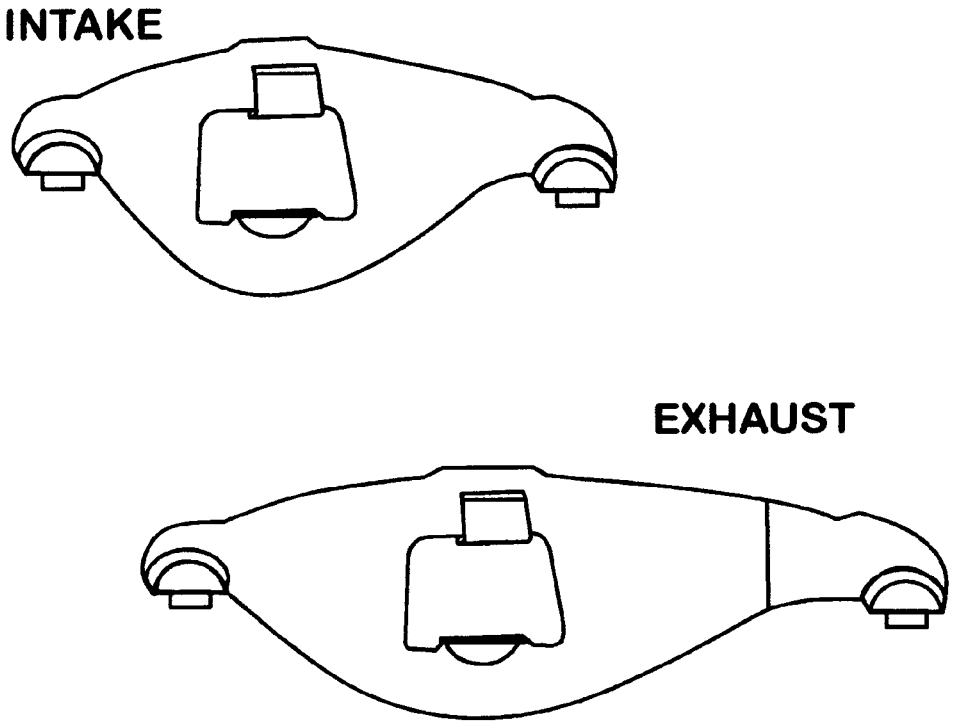
FIG. 17 shows a side view of the rocker arms for the rocker arm assembly shown in FIG. 1.

FIG. 13 shows a side view of a rocker arm 1300 of the rocker arm assembly shown in FIG. 1. The rocker arm 1300 shown is preferably the exhaust rocker arm 135 and 145 shown in FIG. 1. In a preferred embodiment, the intake rocker arms 115 and 125 will have the same configuration as the rocker arm 1300 shown in here, albeit smaller as shown in FIG. 17. Those of skill in the art will recognize that the length and size of the rocker arms 115, 125, 135 and 145 will be determined by the location of the intake and exhaust valves in relation to the rocker arm assembly 120, 130, 140. If the location of the valves changes, the lengths of the rocker arms 115, 125, 135 and 145 will change accordingly. The rocker arms could be the same or different sizes depending on a particular engine application.

FIG. 13 shows the rocker arm 1300 assembled with a pivot foot 1305, a pivot foot member 1353 and a pivot foot clip 1363 with securing prongs 1365. The pivot foot member 153 shown generally has a "mushroom" shape with a curved top 1354 and flat bottom 1355. The pivot foot clip 1363 holds the curved top surface 1354 of the pivot foot member 1353 against a corresponding indent surface in the pivot foot cup 213 of the rocker arm 1300. When the rocker arm 1300 is actuated, the curved top surface 1354 moves along the indent surface of the pivot foot cup 213 while the flat surface 1355 maintains level contact with the valve or valve bridge (not shown). The generally "mushroom" shape tends to reduces wear of the valve assembly.

The rocker arm 1300 preferably comprises a pivot foot 1305, a push rod cup 1310, and a rocker arm aperture 275 with a pivot ball cup 255 in a bottom portion 1375 of the aperture 275. The pivot ball cup 255 preferably has a cup or bowl-like configuration to accept the pivot ball (not shown). The pivot ball cup 255 could also have other appropriate configurations that will hold the pivot ball. Further, the pivot foot is preferably comprised of a the pivot foot retaining clip or fastener 1363 which secures the pivot foot member 1353 to the pivot foot cup 213. The pivot foot clip 1363 preferably secures the pivot foot member 1353 by having its securing prongs 1365 wrapped or crimped around the outside of the pivot foot cup 213. Those of skill in the art will readily recognize that the pivot foot retaining clip 1363 can be configured differently and secured to the rocker arm differently. For example, the pivot foot clip 1363 could instead wrap the securing prongs 1365 completely around the front end 213 of the rocker arm 1300, or insert the securing prongs 1365 in the front end 213, to secure the pivot foot member 1353.

Furthermore, like the fulcrum plate divots or dimples 1060 and 1065 (shown in FIGS. 10*b*, 11*b* and 12*b*) there are also divots or dimples (not shown) in the rocker arm push rod cups 117, 127, 137, 147 and 1310, pivot ball cups 250, 255, 350 and 455, and pivot foot cups 223, 233, 323 and 423. The dimples or divots will also preferably hold oil for lubrication of parts and will allow for clearance between parts.

Figure 14A:
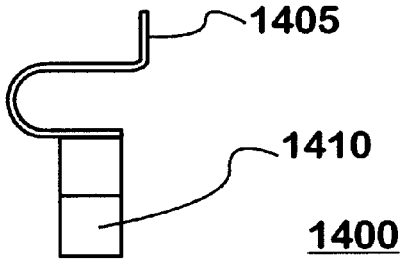
FIGS. 14*a* and 14*b* show a front and side view of a retaining clip of the rocker arm assembly shown in FIGS. 8 and 9.
Figure 14B:
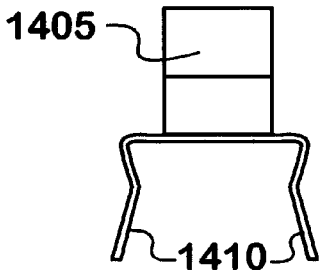

FIGS. 14*a* and 14*b* show a side and front and bottom view of a rocker arm retaining clip 1400 of the rocker arm assembly shown in FIGS. 2*b*, 3*b*, 4*b*, 8 and 9. The retaining clip 1400 is comprised of bottom clamp portion 1410 and a top curved spring portion 1405. The bottom clamp section 1410 of the retaining clip 1400 will be preferably positioned on fulcrum neck portions 1007, 1012, 1112 and 1207 on fulcrum plate ends 207, 212, 312 and 407 preferably via a compression fit. The top spring portion 1405 of the retainer clip 1400 will preferably be inserted into a rocker arm aperture 270, 275, 370 and 475 (shown in FIGS. 2*b*, 3*b* and 4*b*). The rocker arm assembly 120,130 and 40 will be assembled by compressing the top spring portion 1405 the rocker arms 115, 125 135 and 1455 and moving or swinging the rocker arm 115, 125, 135 and 145 towards the appropriate fulcrum plate 128, 138 and 148 until the pivot ball 215, 220, 315, and 220 "snaps" into the indent portion or pivot ball area 260, 265, 360 and 465 in the underside of the fulcrum plate 128,138 and 148 (shown in FIGS. 2*b*, 3*b* and 4*b*).

FIG. 15 shows a top perspective view of the rocker arm assembly 120, 130, 140 and 1530 on an expanded rocker carrier 2 used on one side of a V-8 engine. Those of skill in the art will readily recognize that the rocker arm assembly shown in FIG. 15 is essentially the same as that shown in FIG. 1. While FIG. 1 shows a rocker arm assembly 120, 130 and 140 mounted on a cylinder head of a six-cylinder engine with a V-type configuration. FIG. 15 instead shows the rocker arm assembly 120, 130, 140 and 1530 mounted on a cylinder head of an eight-cylinder engine with a V-type configuration. Thus, FIG. 15 shows an additional dual rocker arm assembly 1530 which is the same as the dual rocker arm assembly 130 described and discussed with reference to FIG. 1.

Figure 16:
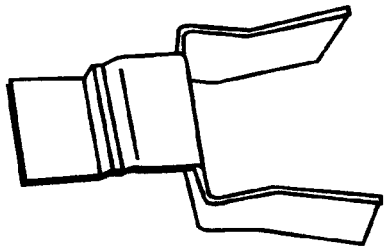
FIG. 16 show a perspective front view of the retaining clip of the rocker arm assembly shown in FIGS. 14*a* and 14*b;*

FIG. 16 show a perspective view of the rocker arm retaining clip for the rocker arm assemblies 120, 130 and 140 shown in FIGS. 14*a* and 14*b*. FIG. 17 shows a side view of the rocker arms for the rocker arm assemblies 120, 130 and 140 shown in FIGS. 1–6, 15 and 18–20. FIG. 17 shows that the rocker arms 115, 125, 135 and 145 is preferably determined by the location of the intake and exhaust valves in relation to the rocker arm assemblies 120, 130 and 140. If the location of the intake and exhaust valves changes, the lengths of the rocker arms 115, 125, 135 and 145 will change accordingly.

Figure 18:
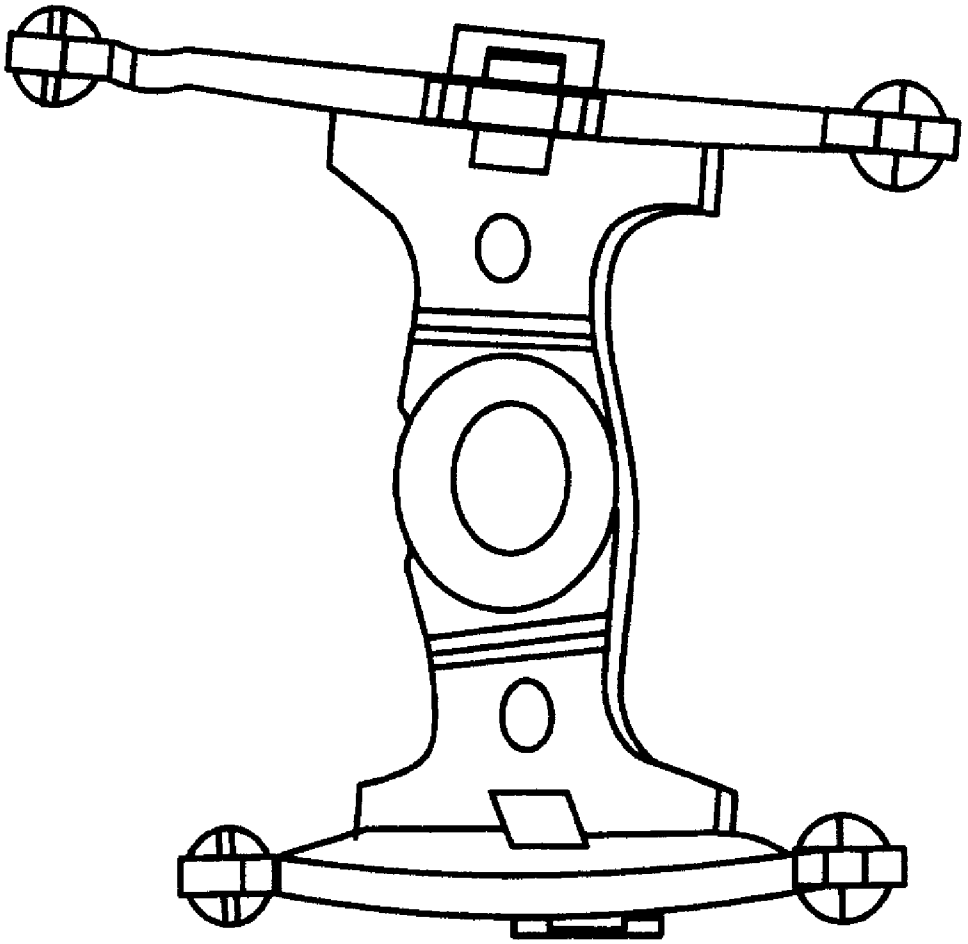
FIG. 18 show a top perspective view of the dual rocker arm assembly shown in FIGS. 1, 2, and 15.
Figure 19:
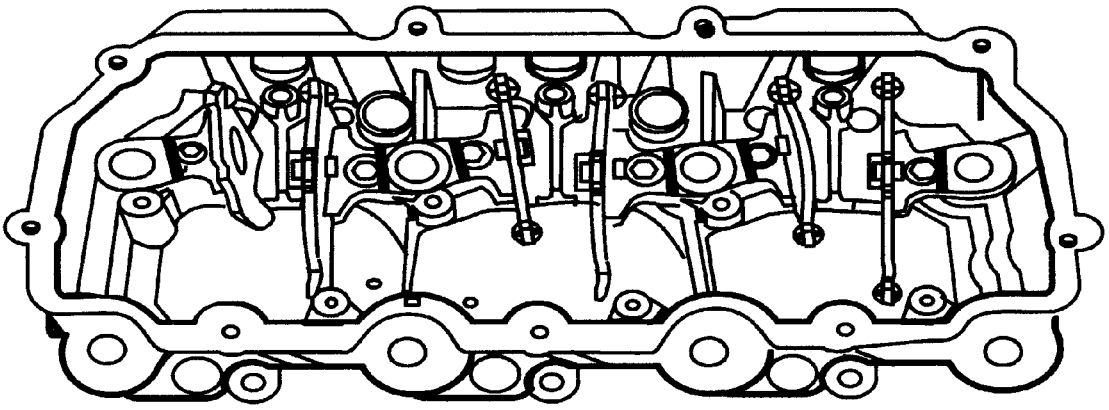
FIG. 19 shows a top perspective view of the rocker arm assembly on the rocker carrier shown in FIG. 1.

FIG. 18 shows a top perspective view of the dual rocker arm assembly 130 where the intake and exhaust rocker arms 125 and 135 are preferably assembled on the dual fulcrum plate 138 (also shown in FIGS. 1, 2, and 15). FIG. 19 shows a top perspective view of the rocker arm assemblies 120, 130 and 140 preferably installed on the rocker carrier 1 (also show in FIGS. 1 and 15).

Figure 20:
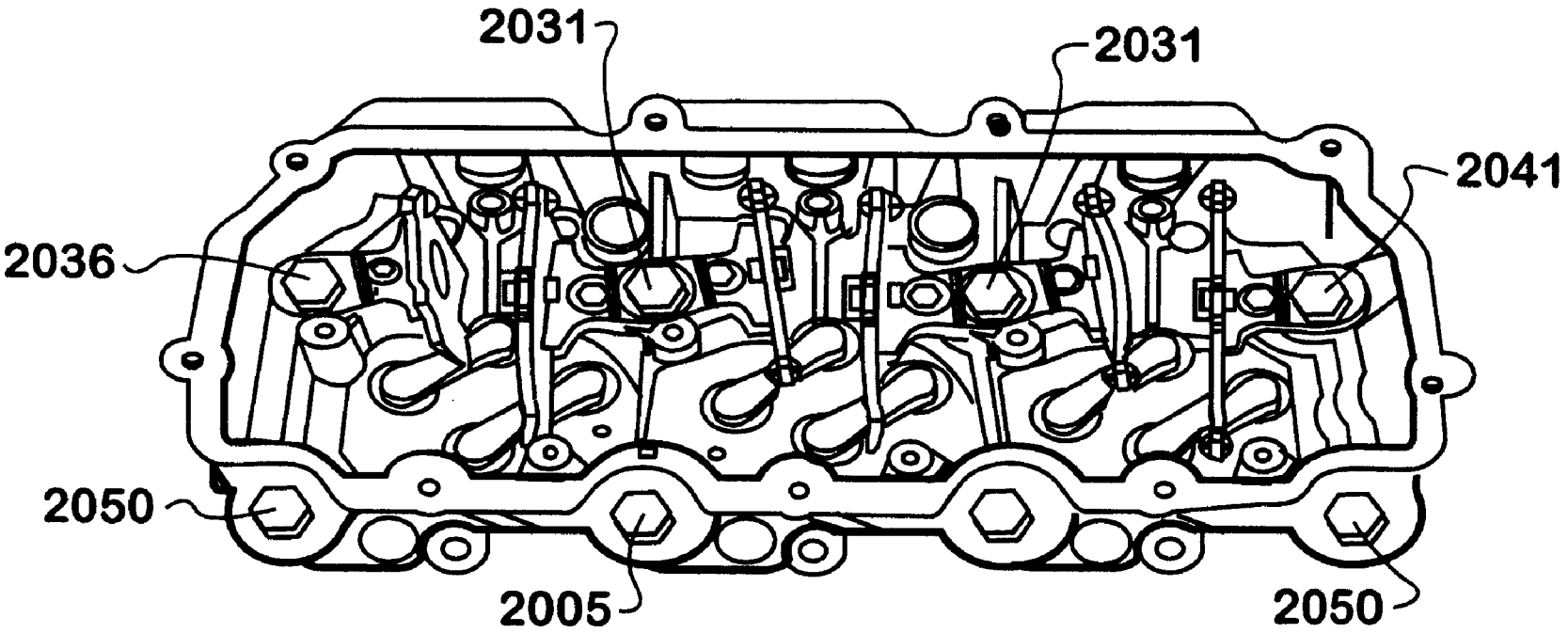
FIG. 20 shows a top perspective view of the rocker arm assembly and rocker carrier of FIGS. 1 and 19 installed on a cylinder head.

FIG. 20 shows a top perspective view of the rocker arm assembly 120, 130 and 140 and the rocker carrier 1 (shown in FIGS. 1 and 19) positioned and installed on a cylinder head 2005. There is shown the rocker arm assemblies 120, 130 and 140 preferably attached to the rocker carrier 1 by the hold down bolts 36, 31 and 41. A plurality of interior head bolts 2036, 2031 and 2041 and exterior head bolts 2050 further attach the cylinder head 2005, with the rocker carrier 1, to the crankcase to complete the engine assembly. The invention has been described and illustrated with respect to certain preferred embodiments by way of example only. Those skilled in that art will recognize that the preferred embodiments may be altered or amended without departing from the true spirit and scope of the invention. Therefore, the invention is not limited to the specific details, representative devices, and illustrated examples in this description. The present invention is limited only by the following claims and equivalents.

We claim:

1. A rocker arm assembly for mounting on a rocker carrier in an internal combustion engine, the rocker arm assembly comprising:

a rocker arm comprising a push rod cup, an aperture, a pivot ball cup, a pivot foot cup, and a pivot foot member being cooperatively fastened by a pivot foot clip to the pivot foot cup;

a fulcrum plate;

a retaining clip;

a pivot ball able to, in cooperation with the retaining clip, cooperatively connect the fulcrum plate and the rocker arm;

whereby the pivot ball provides a pivot point for the rocker arm to pivot about and thereby actuate a valve.

2. The rocker arm assembly of claim 1, wherein the fulcrum plate is an end fulcrum plate.

3. The rocker arm assembly of claim 2, wherein the rocker arm is an intake rocker arm or an exhaust rocker arm.

4. The rocker arm assembly of claim 1, wherein the rocker arm actuates the valve via the pivot foot acting on a valve bridge.

5. The rocker arm assembly of claim 1, wherein the fulcrum plate is a dual fulcrum plate or an end fulcrum plate.

6. The rocker arm assembly of claim 5, wherein the rocker arm is an intake rocker arm or an exhaust rocker arm.

7. The rocker arm assembly of claim 6, wherein the fulcrum plate is 10 millimeters thick.

8. The rocker arm assembly of claim 7, wherein the fulcrum plate comprises a hold down bolt passage and a head bolt passage.

9. The rocker arm assembly of claim 1, wherein the fulcrum plate is a dual fulcrum plate.

10. The rocker arm assembly of claim 9, further comprising an intake rocker arm and an exhaust rocker arm.

11. The rocker arm assembly of claim 10, wherein the intake rocker arm and exhaust rocker arms actuate valves on different engine cylinders.

12. The rocker arm assembly of claim 11, wherein the dual rocker arm fulcrum plate is 10 millimeters thick.

13. The rocker arm assembly of claim 12, wherein the dual rocker arm fulcrum plate comprises a hold down bolt passage and a head bolt passage.

14. The rocker arm assembly of claim 3, wherein the end rocker arm fulcrum plate is 10 millimeters thick.

15. The rocker arm assembly of claim 14, wherein the end rocker arm fulcrum plate comprises a hold down bolt passage and a head bolt passage.

16. A rocker arm assembly for mounting on a rocker carrier in an internal combustion engine, the rocker arm assembly comprising:

a rocker arm comprising a push rod cup, an aperture, a pivot ball cup, a pivot foot cup, and a pivot foot;

an end fulcrum plate;

a retaining clip;

a pivot ball able to, in cooperation with the retaining clip, cooperatively connect the end fulcrum plate and the rocker arm;

whereby the rocker arm pivots via the pivot ball to appropriately actuate a valve bridge.

17. The rocker arm assembly of claim 16, wherein the dual fulcrum plate comprises a hold down bolt passage and a head bolt passage.

18. A rocker arm assembly for mounting on a rocker carrier in an internal combustion engine, the rocker arm assembly comprising:

a rocker arm having a push rod cup, an aperture, a pivot ball cup, a pivot foot cup, and a pivot foot;

a fulcrum plate;

a retaining clip;

a pivot ball able to, in cooperation with the retaining clip, cooperatively connect the fulcrum plate and the rocker arm;

whereby the pivot ball provides a pivot point for the rocker arm to pivot about and thereby actuate a valve bridge via the pivot foot.

19. The rocker arm assembly of claim 18, wherein the fulcrum plate is a dual fulcrum plate or an end fulcrum plate.

20. The rocker arm assembly of claim 19, wherein the rocker arm is an intake rocker arm or an exhaust rocker arm.

21. The rocker arm assembly of claim 20, wherein the fulcrum plate comprises a hold down bolt passage and a head bolt passage.

22. A rocker arm assembly for mounting on a rocker carrier in an internal combustion engine, the rocker arm assembly comprising:

an exhaust rocker arm;

an intake rocker arm;

a dual fulcrum plate;

at least one retaining clip;

at least one pivot ball able to, in cooperation with the at least one retaining clip, cooperatively connect the dual fulcrum plate and the exhaust and intake rocker arms;

whereby the exhaust and intake rocker arms each pivot via a corresponding pivot ball to appropriately actuate a corresponding valve bridge on different engine cylinders.

23. The rocker arm assembly of claim 22, wherein the exhaust and intake rocker arms each comprise:

a push rod cup;

an aperture;

a pivot ball cup; and a pivot foot.

24. The rocker arm assembly of claim 23, wherein the dual fulcrum plate comprises a hold down bolt passage and a head bolt passage.

25. The rocker arm assembly of claim 16, wherein the rocker arm is an intake rocker arm or an exhaust rocker arm.

* * * * *